US011644174B2

(12) United States Patent
Horikawa

(10) Patent No.: US 11,644,174 B2
(45) Date of Patent: May 9, 2023

(54) VEHICLE LIGHT FIXTURE

(71) Applicant: KOITO MANUFACTURING CO., LTD., Tokyo (JP)

(72) Inventor: Akihito Horikawa, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/439,555

(22) PCT Filed: Apr. 3, 2020

(86) PCT No.: PCT/JP2020/015295
§ 371 (c)(1),
(2) Date: Sep. 15, 2021

(87) PCT Pub. No.: WO2020/209192
PCT Pub. Date: Oct. 15, 2020

(65) Prior Publication Data

US 2022/0154907 A1 May 19, 2022

(30) Foreign Application Priority Data

Apr. 11, 2019 (JP) ..... JP2019-075512

(51) Int. Cl.
*F21S 43/239* (2018.01)
*F21S 43/237* (2018.01)

(52) U.S. Cl.
CPC ..... *F21S 43/239* (2018.01); *F21S 43/237* (2018.01)

(58) Field of Classification Search
CPC ..... F21S 43/239; F21S 43/245; F21S 43/249
See application file for complete search history.

(56) References Cited

U.S. PATENT DOCUMENTS 9,151,461 B1 * 10/2015 Kuo ..... F21S 43/26
2013/0010486 A1 1/2013 Koito
(Continued)

FOREIGN PATENT DOCUMENTS

EP 2159477 A2 * 3/2010 ..... F21S 43/14
JP 2013-016386 A 1/2013
(Continued)

OTHER PUBLICATIONS

International Search Report dated Jun. 16, 2020 issued in PCT/JP2020/015295.
(Continued)

*Primary Examiner* — Julie A Bannan
(74) *Attorney, Agent, or Firm* — Pearne & Gordon LLP

(57) ABSTRACT

To improve design characteristics when the light fixture is turned on in a vehicle light fixture including a plate-shaped light guide. The plate-shaped light guide (32) is configured such that light from five light sources (40A1, 40A2, 40A3, 40A4 and 40A5) is totally reflected by a plurality of reflective elements (32*s*) formed on a first plate surface (32*a*) on a rear surface side of the plate-shaped light guide, and then emitted forward of a light fixture unit from a second plate surface (32*b*) of the plate-shaped light guide. At that time, five light emitting regions (32A1, 32A2, 32A3, 32A4 and 32A5) are arranged at intervals in a horizontal direction in the plate-shaped light guide (32), and then the reflective elements (32*s*) are arranged in a state of being continuously side by side along a line L extending in a direction intersecting the horizontal direction in each of the light emitting regions (32A1 to 32A5). Each reflective element (32*s*) is formed in a substantially concave spherical surface shape. In addition, the light sources (40A1 to 40A5) are configured to be able to be individually turned on in a state of being
(Continued)

respectively arranged in the light emitting regions (32A1 to 32A5).

5 Claims, 10 Drawing Sheets

(56) References Cited

U.S. PATENT DOCUMENTS

| | | | | |
|---|---|---|---|---|
| 2014/0160778 | A1* | 6/2014 | Nakada | B60Q 1/2607 362/511 |
| 2019/0011626 | A1* | 1/2019 | Gloss | F21S 43/249 |

FOREIGN PATENT DOCUMENTS

| | | | |
|---|---|---|---|
| JP | 2013-149502 | A | 8/2013 |
| JP | 2015-145224 | A | 8/2015 |
| JP | 2015-191686 | A | 11/2015 |

OTHER PUBLICATIONS

Office Action dated Nov. 24, 2022 for the corresponding Chinese Patent Application No. 202080021171.6.

* cited by examiner

VEHICLE LIGHT FIXTURE

TECHNICAL FIELD

The present invention relates to a vehicle light fixture including a plate-shaped light guide.

BACKGROUND ART

In the related art, a vehicle light fixture is known which is configured such that light from a light source incident on a plate-shaped light guide is totally reflected by a plurality of reflective elements formed on a first plate surface of the plate-shaped light guide, and then emitted forward of the light fixture from a second plate surface of the plate-shaped light guide.

As such a vehicle light fixture, "PATENT LITERATURE 1" describes the vehicle light fixture which is configured such that the light emitted from a plurality of light sources arranged along a rear end surface of the plate-shaped light guide is then incident on the plate-shaped light guide from the rear end surface.

On the other hand, as the vehicle light fixture, "PATENT LITERATURE 2" describes the vehicle light fixture configured to include a light emitter in which a plurality of light emitting elements is arranged side by side, and configured such that the light sources respectively arranged in the light emitting elements are sequentially turned on.

CITATION LIST

Patent Literature

PATENT LITERATURE 1: JP-A-2013-016386
PATENT LITERATURE 2: JP-A-2015-145224

SUMMARY OF INVENTION

Problems to be Solved by Invention

By employing the configuration described in the above "PATENT LITERATURE 1", it is possible to make the plate-shaped light guide appear to emit light substantially uniformly in a front view of the light fixture. However, since the plate-shaped light guide is configured such that the reflective elements are formed in a stepped manner on the first plate surface on a rear surface side of the plate-shaped light guide, a line-of-sight direction in which the plate-shaped light guide looks bright and shining is limited.

On the other hand, by employing the configuration described in the above "PATENT LITERATURE 2", it is possible to change the way the light emitter emits light, but it is not possible to give a characteristic to the way each light emitting element itself emits light.

On the other hand, it is desired to improve design characteristics when the light fixture is turned on as the vehicle light fixture.

The present invention has been made in view of such circumstances, and an object of the present invention is, in the vehicle light fixture including the plate-shaped light guide, to provide the vehicle light fixture capable of improving the design characteristics when the light fixture is turned on.

Solution to Problems

The present invention is the vehicle light fixture configured such that the light sources can be individually turned on, and the above object is achieved by devising a configuration of the plate-shaped light guide.

Specifically, a vehicle light fixture according to the present invention includes a light source and a plate-shaped light guide, in which the plate-shaped light guide is configured such that light from the light source incident on the plate-shaped light guide is totally reflected by a plurality of reflective elements formed on a first plate surface of the plate-shaped light guide, and then emitted forward of the light fixture from a second plate surface of the plate-shaped light guide, a plurality of light emitting regions is arranged at intervals in a required direction in the plate-shaped light guide, the plurality of reflective elements is arranged in a state of being continuously side by side along a line extending in a direction intersecting the required direction in each of the light emitting regions, each of the reflective elements has a substantially spherical surface shape, the light source is disposed in each of the light emitting regions, and a plurality of the light sources is configured to be able to be individually turned on.

A type of the "light source" is not particularly limited, and for example, a light emitting diode, an incandescent bulb, a laser diode, and the like can be employed.

If the above "plate-shaped light guide" is configured such that the light from the light source incident on the plate-shaped light guide is totally reflected by the reflective elements formed on the first plate surface of the plate-shaped light guide, and then emitted forward of the light fixture from the second plate surface of the plate-shaped light guide, a specific shape such as an outer shape and a surface shape of the plate-shaped light guide is not particularly limited.

A specific direction of the above "required direction" is not particularly limited.

If the above "plurality of light emitting regions" is arranged at intervals in the required direction, a specific arrangement of the light emitting regions is not particularly limited.

The above "state of being continuously side by side along a line" of course includes a state in which the reflective elements are in close contact with each other, but also includes a state in which the reflective elements are slightly separated from each other as long as the plate-shaped light guide appears to shine linearly due to the light from the light source totally reflected by the reflective elements.

The above "plurality of reflective elements" may be arranged in a row on the line, or may be arranged in parallel by a plurality in the required direction on the line.

The above "substantially spherical surface shape" means a concave curved surface shape or a convex curved surface shape, which has a spherical surface or a shape close thereto (for example, an elliptical spherical surface or a polyhedron).

Effects of Invention

The vehicle light fixture according to the present invention is configured such that the light from the light source incident on the plate-shaped light guide is totally reflected by the reflective elements formed on the first plate surface of the plate-shaped light guide, and then emitted forward of the light fixture from the second plate surface of the plate-shaped light guide, but the light emitting regions are arranged at intervals in a required direction in the plate-shaped light guide, the reflective elements are arranged in a state of being continuously side by side along a line extending in a direction intersecting the required direction in each of the light emitting regions, each of the reflective elements has a substantially spherical surface shape, and the light sources are configured to be able to be individually turned on in a state of being respectively arranged in the light emitting regions, so that the following operational effects can be obtained.

That is, in the plate-shaped light guide, in the light emitting regions on which the light from the light sources in a lighting state out of the light emitting regions is incident, the light from the light sources is totally reflected by the reflective elements and emitted forward of the light fixture from the second plate surface, so that the plate-shaped light guide can be made to appear to shine linearly along the line.

At that time, since each reflective element formed on the first plate surface of the plate-shaped light guide has a substantially spherical surface shape, light reflection by total reflection in the reflective elements will be performed substantially evenly in all directions. Therefore, even if the line-of-sight direction when observing the plate-shaped light guide is significantly changed, it is possible to maintain a state in which the plate-shaped light guide appears to shine linearly along the line, so that optical fibers can be made to appear to shine in each of the light emitting regions.

Moreover, since the light sources respectively arranged in the light emitting regions are configured to be able to be individually turned on, it is also possible to selectively make a part of the light emitting regions appear to shine.

Then, by making a part or all of the light emitting regions appear to shine like the optical fibers in this way, the design characteristics of the vehicle light fixture can be improved.

As described above, according to the present invention, in the vehicle light fixture including the plate-shaped light guide, it is possible to improve the design characteristics when the light fixture is turned on.

In the above configuration, in addition, if a plurality of the lines is arranged at intervals in the required direction in each of the light emitting regions, in the light emitting regions on which the light from the light sources in the lighting state is incident, it is possible to make the optical fibers appear to shine in a state of being arranged discretely, thereby further improving the effects of the design characteristics.

In the above configuration, in addition, if each of the light sources includes a light emitting element, and a light incident member that allows light from each of the light sources to be incident on the plate-shaped light guide so that the light is guided to each of the light emitting regions is disposed between each of the light sources and one end surface of the plate-shaped light guide in the direction intersecting the required direction, even if each light source includes the light emitting element, it is possible to easily emit light only in the light emitting region corresponding to the light source by individually turning on the light source.

At that time, if a plurality of the light incident members is formed to extend in different directions from each other from the one end surface of the plate-shaped light guide between the light incident members adjacent to each other, even if the light emitting regions are close to each other, the light incident members and the light sources can be arranged without difficulty.

Note that the above "light incident member" may be formed integrally with the plate-shaped light guide or may be formed separately.

In the above configuration, in addition, if the vehicle light fixture is configured to include: a rod-shaped light guide disposed to extend along the other end surface of the plate-shaped light guide in the direction intersecting the required direction; and a second light source disposed such that light is incident on the rod-shaped light guide, and the rod-shaped light guide is configured such that the light from the second light source incident on the rod-shaped light guide is incident on the plate-shaped light guide from the other end surface, it is possible to increase brightness of the light emitting regions by additionally turning on the second light source when the light emitting regions emit light by simultaneously turning on the light sources.

Note that the above "rod-shaped light guide" may be formed integrally with the plate-shaped light guide or may be formed separately.

In the above configuration, in addition, if the vehicle light fixture includes: a second plate-shaped light guide disposed behind the light fixture from the plate-shaped light guide; and a third light source disposed such that light is incident on the second plate-shaped light guide, and the second plate-shaped light guide is configured such that the light from the third light source incident on the second plate-shaped light guide is totally reflected by the reflective elements formed on a first plate surface of the second plate-shaped light guide, and then emitted forward of the light fixture from a second plate surface of the second plate-shaped light guide, the following operational effects can be obtained.

That is, when the light emitting regions or a part of the light emitting regions emit light by simultaneously or individually turning on the light sources, the second plate-shaped light guide can also be made to appear shining by additionally turning on the third light source, thereby producing a light emitting state with a sense of depth.

At that time, the specific arrangement of the light emitting region in the second plate-shaped light guide, the surface shape of the reflective elements, and the like are not particularly limited.

DESCRIPTION OF EMBODIMENTS

Hereinafter, embodiments of the present invention will be described with reference to the drawings.

Figure 1:
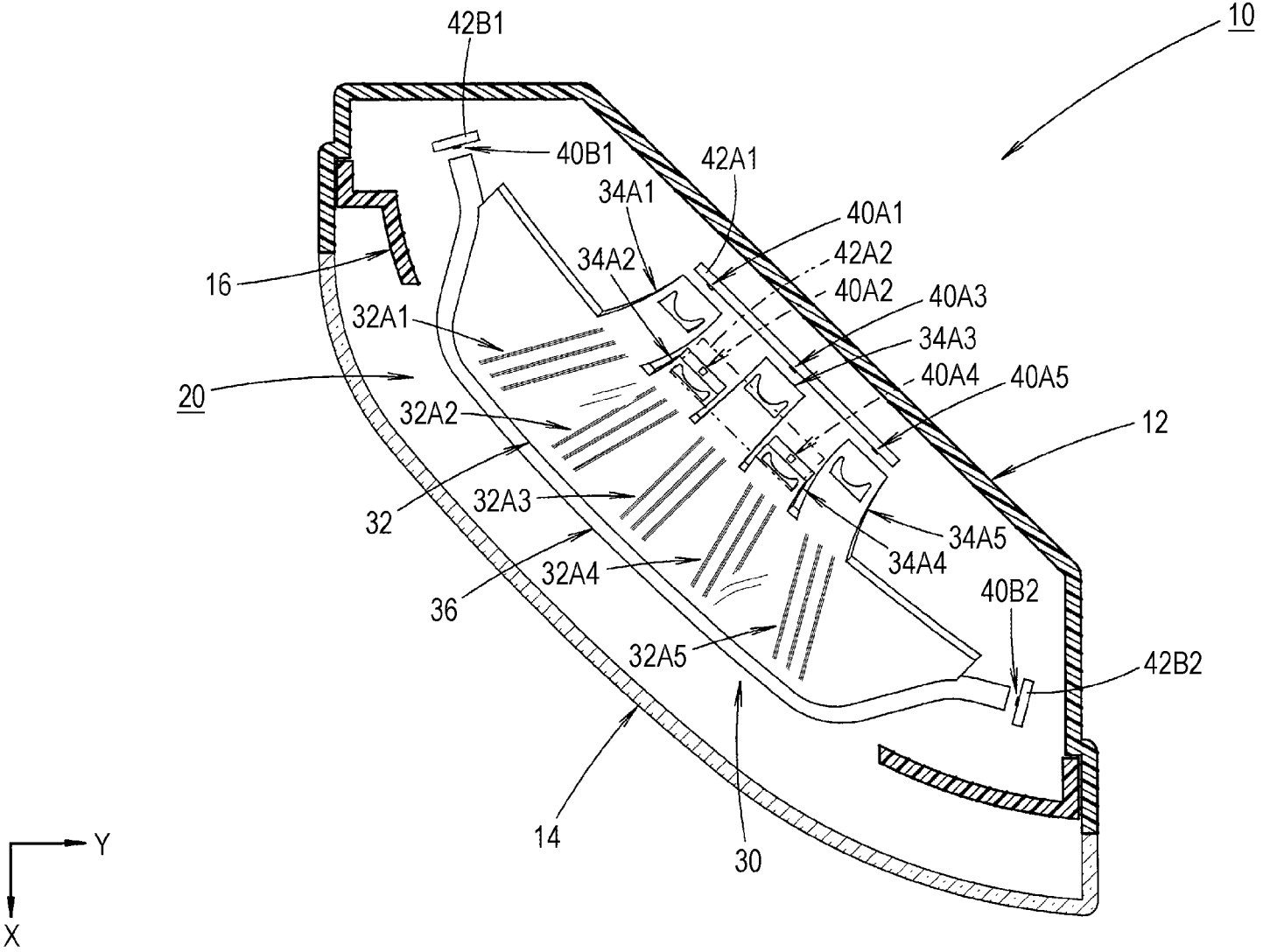
FIG. 1 is a plan view illustrating a vehicle light fixture according to an embodiment of the present invention.
Figure 2:
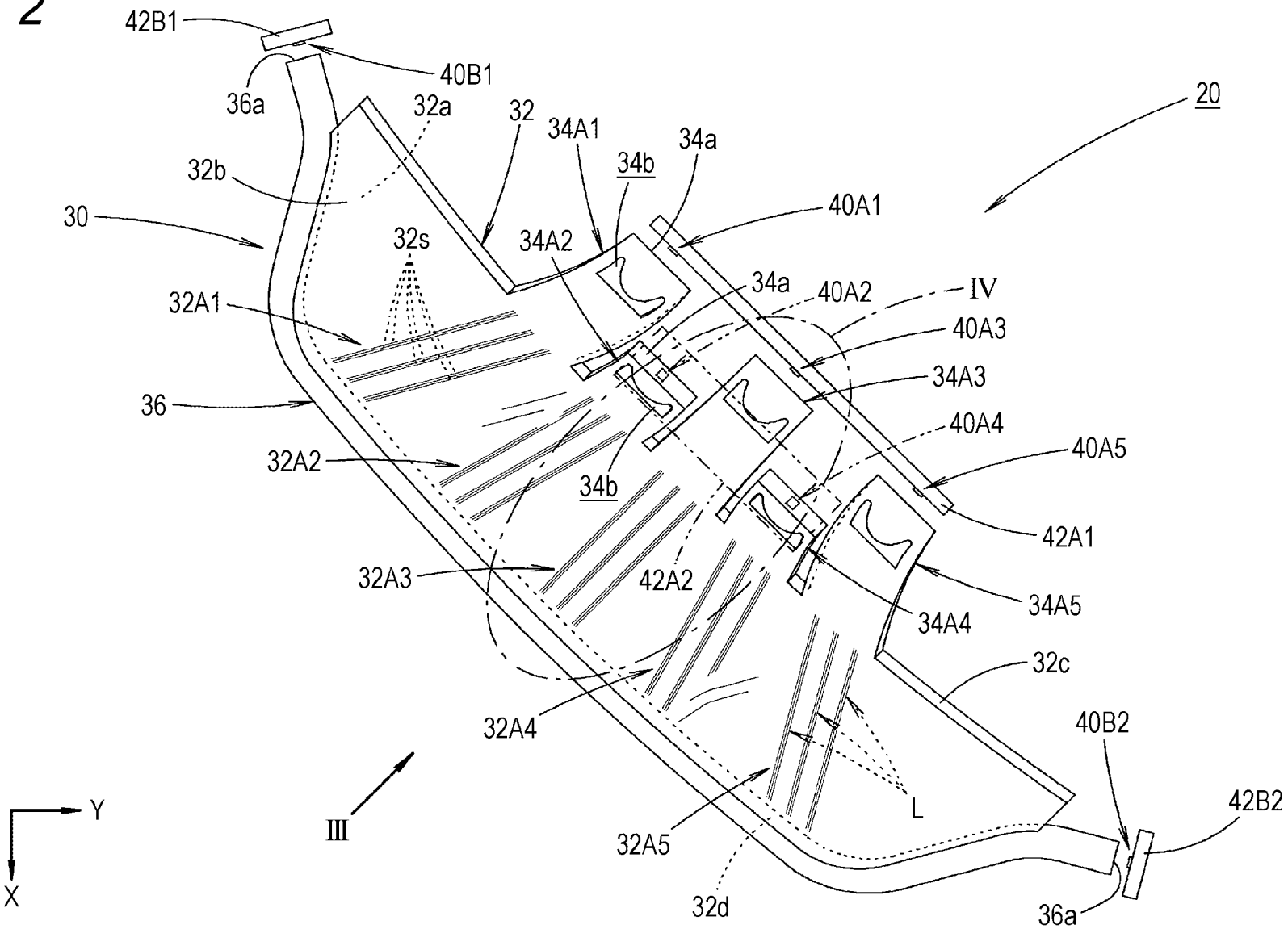
FIG. 2 is a plan view illustrating a light fixture unit taken out of the vehicle light fixture.
Figure 3:
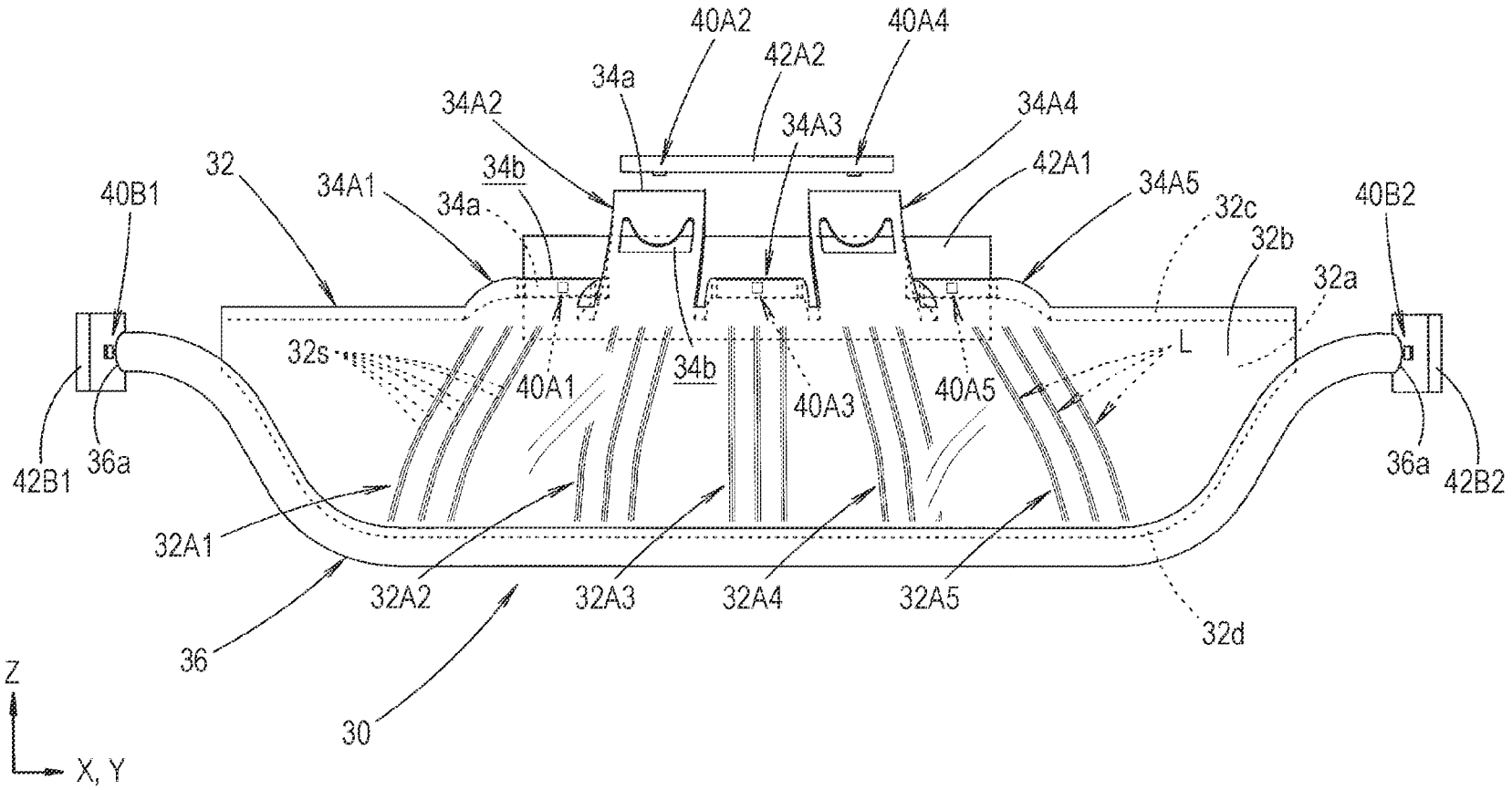
FIG. 3 is a view taken in a direction of an arrow III of FIG. 2.

FIG. 1 is a plan view illustrating a vehicle light fixture 10 according to an embodiment of the present invention. Further, FIG. 2 is a plan view illustrating a light fixture unit 20 taken out of the vehicle light fixture 10, and FIG. 3 is a view taken in a direction of an arrow III of FIG. 2.

In these figures, a direction indicated by X is "front" ("rear" of a vehicle) of the vehicle light fixture 10, a direction indicated by Y is a "right direction" (also the "right direction" of the vehicle), and a direction indicated by Z is an "upper direction". The same applies to figures other than these figures.

As illustrated in FIG. 1, the vehicle light fixture 10 according to the present embodiment is configured as a tail lamp disposed at a left rear end of the vehicle, but also functions as a so-called welcome lamp (this will be described below).

The vehicle light fixture 10 according to the present embodiment is configured such that the light fixture unit 20 is incorporated in a lamp chamber formed by a lamp body 12 and a transparent light transmitting cover 14 attached to a front end opening of the lamp body 12. The light transmitting cover 14 is formed to wrap around rearward of the light fixture and extend from a right end (that is, an inner end in a vehicle width direction) to a left end of the light transmitting cover 14.

In the lamp chamber, an extension member 16 that covers a peripheral edge of the light fixture unit 20 in the front view of the light fixture is disposed. The extension member 16 is configured as a panel-shaped member, and is supported by the lamp body 12 at an outer peripheral edge of the extension member 16.

As illustrated in FIGS. 2 and 3, the light fixture unit 20 is configured to include a light transmitting member 30, five light sources 40A1, 40A2, 40A3, 40A4 and 40A5, and two second light sources 40B1 and 40B2.

The light transmitting member 30 is a colorless transparent resin (for example, acrylic resin) member, and has a structure in which a plate-shaped light guide 32, five light incident members 34A1, 34A2, 34A3, 34A4 and 34A5, and a rod-shaped light guide 36 are integrally formed. Then, the light transmitting member 30 is supported by the lamp body 12 by a support structure (not illustrated).

The plate-shaped light guide 32 is formed with a plate thickness of about 1 to 3 mm (for example, a plate thickness of about 2 mm). The plate-shaped light guide 32 is formed to be curved and extend rearward of the light fixture from a right end to a left end of the plate-shaped light guide 32 along a wraparound shape of the light transmitting cover 14.

As illustrated in FIG. 3, the plate-shaped light guide 32 has a substantially inverted trapezoidal outer shape in which both left and right ends are inclined obliquely upward in the front view of the light fixture unit, which is the direction of the arrow III of FIG. 2 (that is, when viewed from a direction inclined to the left by about 45° from a direction of a front view of the light fixture).

A plurality of reflective elements **32*s* is formed on a first plate surface 32*a* on a rear surface side of the plate-shaped light guide 32**.

Specifically, in the plate-shaped light guide 32, five light emitting regions 32A1, 32A2, 32A3, 32A4 and 32A5 are arranged in a strip shape at intervals in a horizontal direction, and the reflective elements **32*s* are formed in each of the light emitting regions 32A1 to 32A5. In each of the light emitting regions 32A1 to 32A5, the reflective elements 32*s* are arranged in a state of being continuously side by side along a line L extending in a direction intersecting the horizontal direction. Three lines L are arranged in each of the light emitting regions 32A1 to 32A5** at substantially equal intervals in the horizontal direction.

As illustrated in FIG. 2, each line L is formed to extend linearly from a position near an upper end edge to a position near a lower end edge of the plate-shaped light guide 32 in a plan view. At that time, out of the five light emitting regions 32A1 to 32A5, the three lines L constituting the centrally located light emitting region 32A3 are formed to extend in a front-rear direction of the light fixture unit, the three lines L constituting each of a pair of light emitting regions 32A2 and 32A4 adjacent to the light emitting region 32A3 on both sides thereof are formed to extend in a direction away from a front direction of the light fixture unit, and the three lines L constituting each of a pair of light emitting regions 32A1 and 32A5 adjacent to both sides thereof are formed to extend in a direction further away from the front direction of the light fixture unit.

Then, the plate-shaped light guide 32 is configured to totally reflect the light emitted from the light sources 40A1 to 40A5 and the second light sources 40B1 and 40B2 and incident on the plate-shaped light guide 32, by the reflective elements **32*s* formed on the first plate surface 32*a* in each of the light emitting regions 32A1 to 32A5, and then emit the light forward of the light fixture from a second plate surface 32*b* of the plate-shaped light guide 32**.

Figure 4:
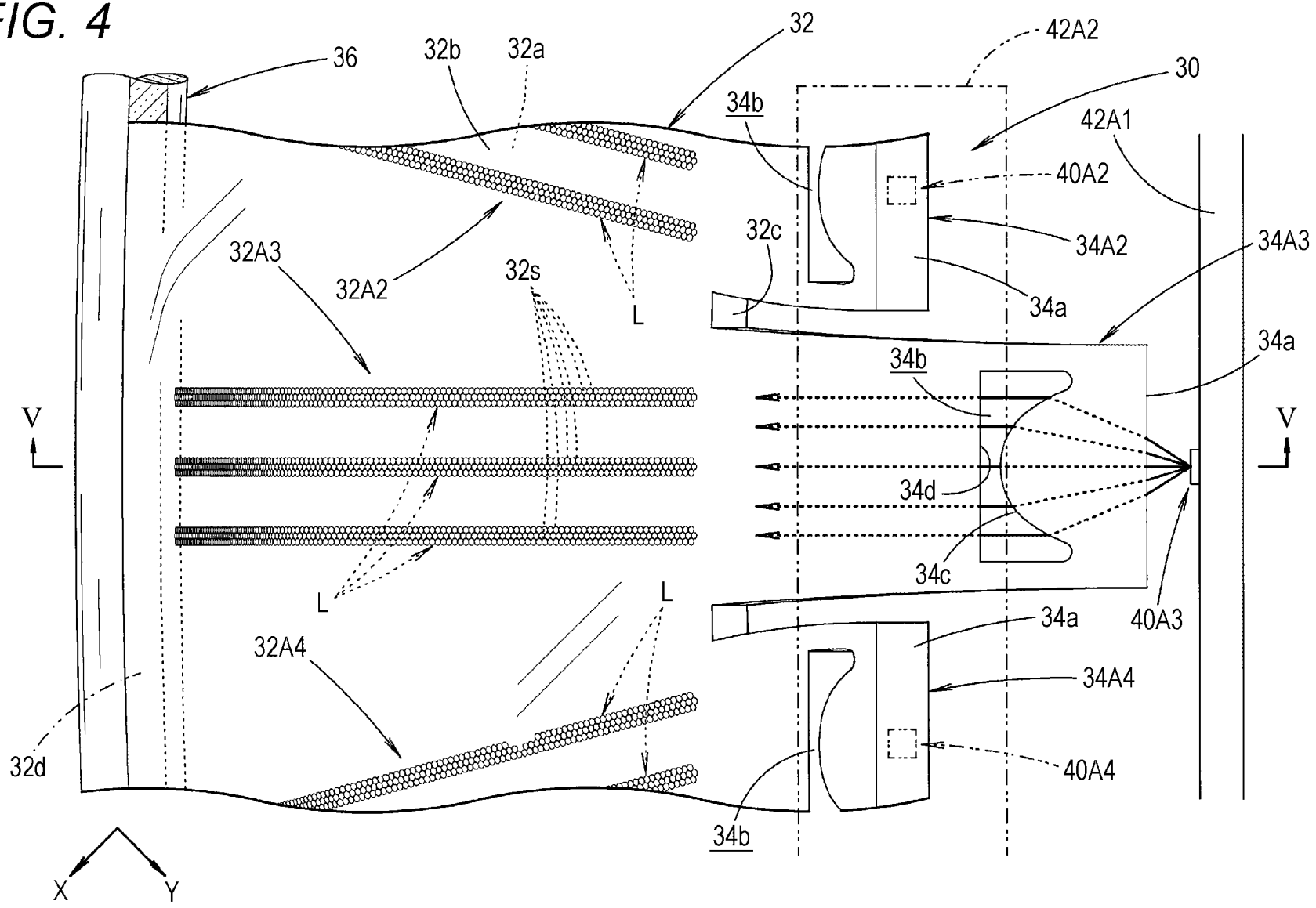
FIG. 4 is a detailed view of a portion IV of FIG. 2.
Figure 5:
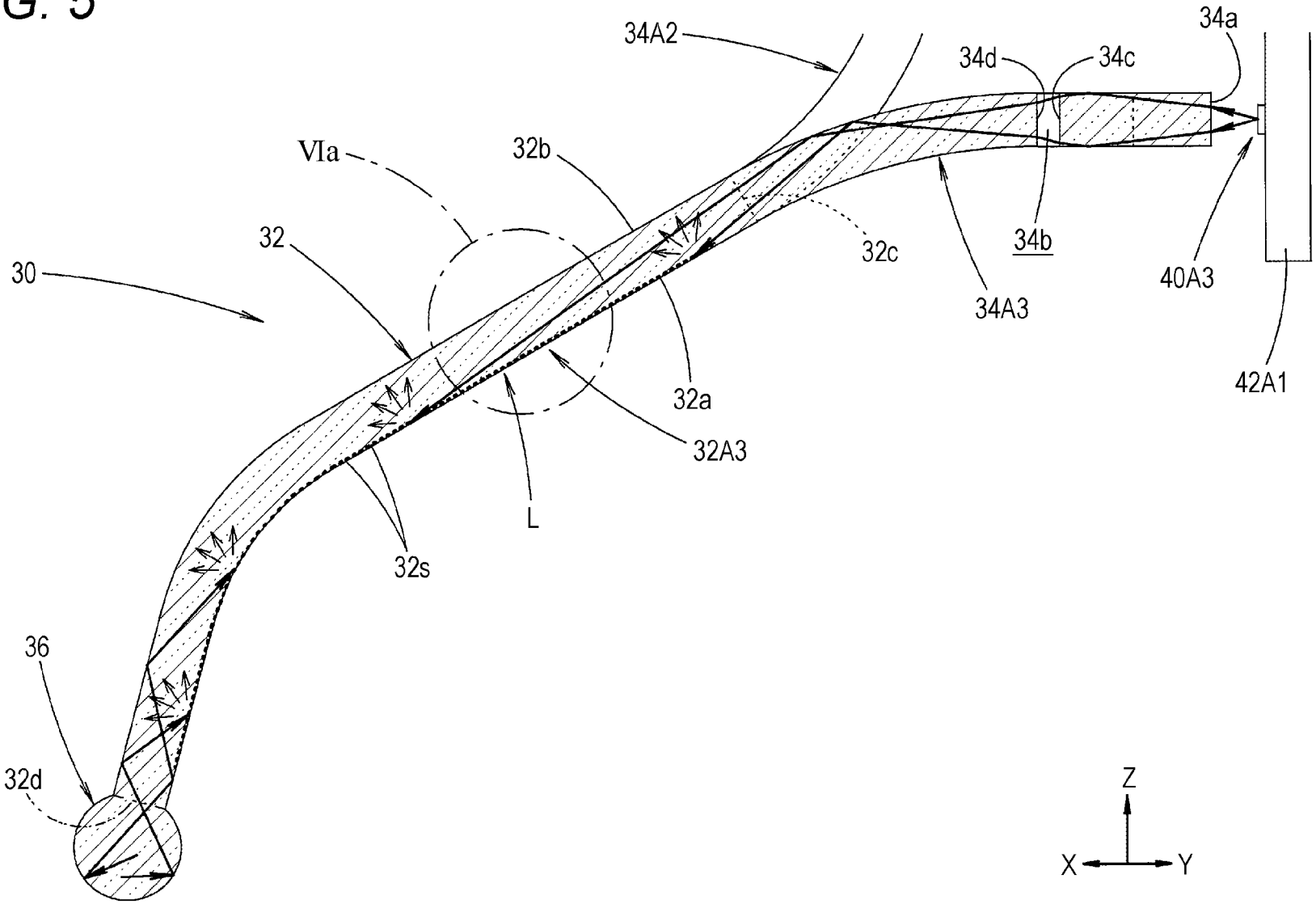
FIG. 5 is a cross-sectional view taken along a line V-V of FIG. 4.

FIG. 4 is a detailed view of a portion IV of FIG. 2, and FIG. 5 is a cross-sectional view taken along a line V-V of FIG. 4.

As illustrated in these figures, the plate-shaped light guide 32 is formed to extend obliquely downward from the upper end edge toward the lower end edge of the plate-shaped light guide 32 forward of the light fixture unit, and is formed so that a downward inclination angle is large at a portion near the lower end edge. Then the plate-shaped light guide 32 is connected to the rod-shaped light guide 36 at an inclination angle larger than 45° (for example, an inclination angle of about 75°) at the lower end edge, and is connected to the five light incident members 34A1 to 34A5 at an inclination angle smaller than 45° (for example, an inclination angle of about 30°) at the upper end edge. Thus, an upper end surface **32*c* of the plate-shaped light guide 32 faces obliquely upward, which is greatly inclined rearward of the light fixture unit, and a lower end surface 32*d* as a virtual surface of the plate-shaped light guide 32** faces obliquely downward slightly inclined forward of the light fixture unit.

As illustrated in FIGS. 2 and 3, the five light incident members 34A1 to 34A5 are formed to extend from the upper end surface **32*c* in a state of being side by side along the upper end surface 32*c* of the plate-shaped light guide 32. At that time, all of the five light incident members 34A1 to 34A5 are formed to have the same plate thickness as the plate-shaped light guide 32** and extend substantially in a strip shape.

Out of the five light incident members 34A1 to 34A5, the three light incident members 34A1, 34A3 and 34A5 arranged every other one are curved and extend in a direction close to horizontal so as to be smoothly connected to the plate-shaped light guide 32, while the two light incident members 34A2 and 34A4 arranged between them are curved and extend in an upward direction so as to be smoothly connected to the plate-shaped light guide 32. Then, tip surfaces **34*a* of the three light incident members 34A1, 34A3 and 34A5 are formed of vertical planes located on the same plane, while tip surfaces 34*a* of the two light incident members 34A2 and 34A4** are formed of horizontal planes located on the same plane.

The rod-shaped light guide 36 is formed in a columnar shape with a diameter of about ϕ4 to 8 mm (for example, a diameter of about ϕ6 mm). The rod-shaped light guide 36 extends in the horizontal direction along the lower end edge of the plate-shaped light guide 32, and portions near both ends of the rod-shaped light guide 36 extend obliquely upward corresponding to the lower end edge of the plate-shaped light guide 32 inclined obliquely upward, and further, both ends of the rod-shaped light guide 36 extend in the horizontal direction so as to be separated from a side end surface of the plate-shaped light guide 32, and tip surfaces 36*a* of the rod-shaped light guide 36 are both formed of a vertical plane.

The five light sources 40A1 to 40A5 and the two second light sources 40B1 and 40B2 are all formed of light emitting elements, and are specifically formed of red light emitting diodes.

The light sources 40A1 to 40A5 are respectively arranged in the vicinity of the tip surfaces 34*a* of the light incident members 34A1 to 34A5 with their light emitting surfaces facing the tip surfaces 34*a*. Then, the light sources 40A1 to 40A5 are configured to allow the light emitted from the light sources 40A1 to 40A5 to be incident on the plate-shaped light guide 32 via the light incident members 34A1 to 34A5.

The three light sources 40A1, 40A3 and 40A5 arranged in the vicinity of the tip surfaces 34*a* of the three light incident members 34A1, 34A3 and 34A5 are mounted on a common substrate 42A1, and the two light sources 40A2 and 40A4 are mounted on a common substrate 42A2.

The two second light sources 40B1 and 40B2 are arranged in the vicinity of the tip surfaces 36*a* at both ends of the rod-shaped light guide 36 with their light emitting surfaces facing the tip surfaces 36*a*. Then, the second light sources 40B1 and 40B2 are configured to allow the light emitted from the second light sources 40B1 and 40B2 to be incident on the rod-shaped light guide 36 from its tip surfaces 36*a*, and to allow the light to be incident on the plate-shaped light guide 32 via the rod-shaped light guide 36.

The second light source 40B1 is mounted on a substrate 42B1, and the second light source 40B2 is mounted on a substrate 42B2.

As illustrated in FIG. 1, the substrates 42A1, 42A2, 42B1 and 42B2 are supported by the lamp body 12.

As illustrated in FIGS. 2 and 3, each of the light incident members 34A1 to 34A5 is formed with a light control opening 34*b* for allowing the light emitted from each of the light sources 40A1 to 40A5 to be incident on the plate-shaped light guide 32 as substantially parallel light.

As an example of the light incident member 34A3 is illustrated in FIGS. 4 and 5, in the light control opening 34*b*, an inner wall surface 34*c* of the light incident member 34A3 on the tip surface 34*a* side is formed of a convex cylindrical curved surface having a convex curved horizontal cross-sectional shape, and an inner wall surface 34*d* of the light incident member 34A3 on the plate-shaped light guide 32 side is formed of a flat surface parallel to the tip surface 34*a*. Then, the light control opening 34*b* is configured to allow the light from the light source 40A3 incident on the light incident member 34A3 from the tip surface 34*a* to be once emitted from the inner wall surface 34*c* into a space inside the light control opening 34*b* as substantially parallel light, and then allow the light to be incident again on the light incident member 34A3 from the inner wall surface 34*d* as the substantially parallel light, and guide the substantially parallel light to the light emitting region 32A3 of the plate-shaped light guide 32.

As illustrated in FIG. 5, the plate-shaped light guide 32 is configured such that while the light from the light source 40A3 incident on the plate-shaped light guide 32 via the light incident member 34A3 is guided in a direction toward the lower end surface 32*d*, the reflective elements 32*s* formed on the first plate surface 32*a* of the light emitting region 32A3 totally reflect the light in a light guiding process, and while the light from the light sources 40B1 and 40B2 (see FIGS. 2 and 3) incident on the plate-shaped light guide 32 via the rod-shaped light guide 36 is guided in a direction toward the upper end surface 32*c*, the reflective elements 32*s* formed on the first plate surface 32*a* of the light emitting region 32A3 totally reflect the light in the light guiding process.

Figure 6:
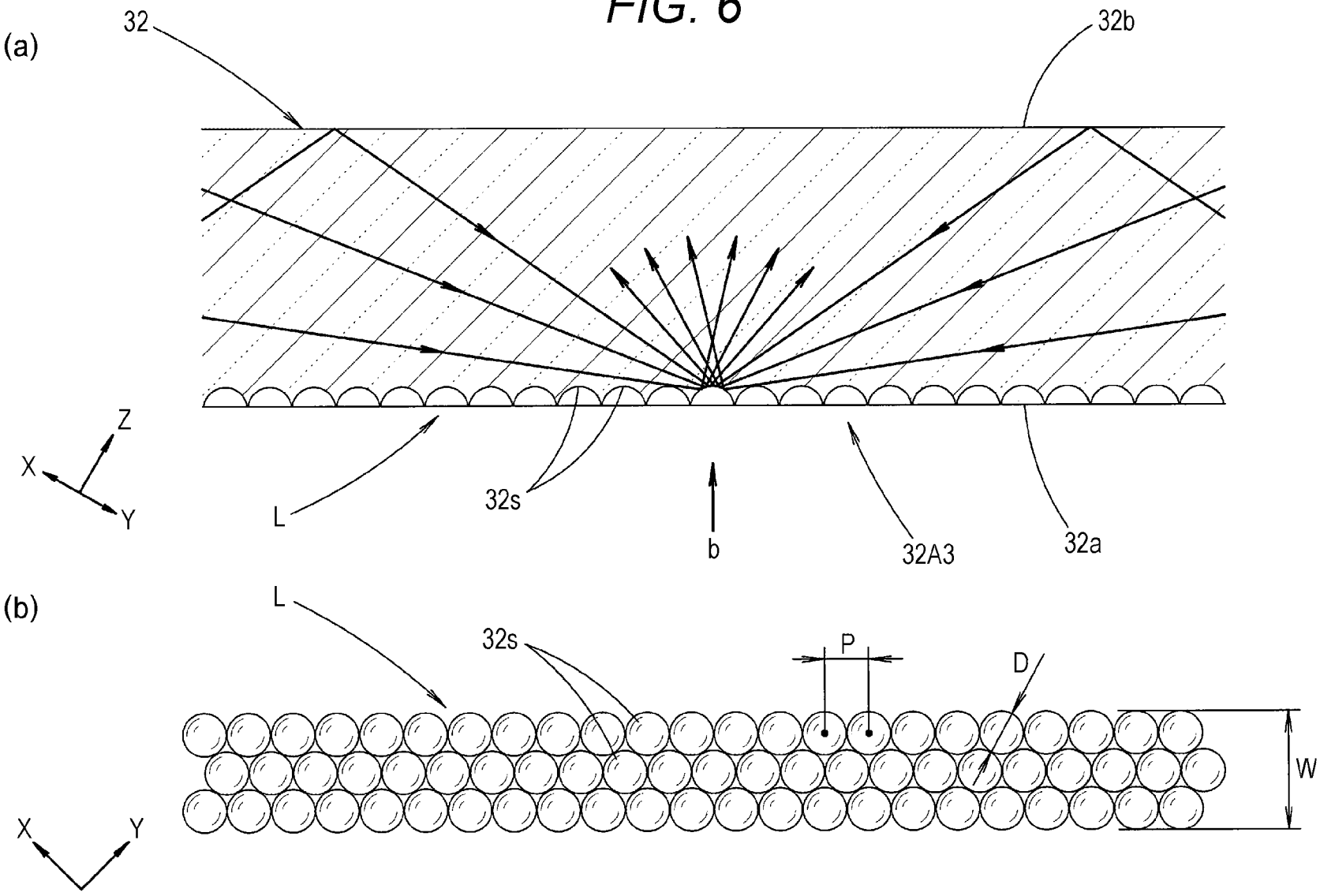
FIG. 6(*a*) is a detailed view of a portion VIa of FIG. 5, and FIG. 6(*b*) is a view taken in a direction of an arrow b of FIG. 6(*a*).

FIG. 6(*a*) is a detailed view of a portion VIa of FIG. 5, and FIG. 6(*b*) is a view taken in a direction of an arrow b of FIG. 6(*a*).

As illustrated in these figures, the reflective elements 32*s* formed in the light emitting region 32A3 are arranged in a state of being continuously side by side in three rows along each line L. At that time, the reflective elements 32*s* are arranged on each line L in a state of being in close contact with each other and in a state of being half-pitch P-shifted between adjacent rows.

Each reflective element 32*s* has a concave spherical surface shape of the same size. Specifically, each reflective element 32*s* is formed in a substantially hemispherical shape, and a radius of the concave spherical surface constituting the surface shape is set to a value of R0.2 to 0.6 mm (for example, about R0.3 mm). Then, an outer diameter D of each reflective element 32*s* is set to a value slightly less than twice the radius of the concave spherical surface (specifically, D=a value of about 0.3 to 1 mm (for example, a value of about 0.5 mm)).

A distance between the three lines L constituting the light emitting region 32A3 is set to a value larger than a width W of each line L (for example, a value of about 2 to 10W).

The same applies to the other light emitting regions 32A1, 32A2, 32A4 and 32A5 with respect to the above points.

The vehicle light fixture 10 according to the present embodiment is configured such that in a tail lamp lighting mode, all of the five light sources 40A1 to 40A5 and the two second light sources 40B1 and 40B2 are simultaneously turned on, while in a welcome lamp lighting mode (that is, a mode in which the light is turned on when the driver approaches or leaves the vehicle), the two second light sources 40B1 and 40B2 are not turned on, and the five light sources 40A1 to 40A5 are individually turned on for a certain period of time in the order of the light sources 40A1, 40A2, 40A3, 40A4, and 40A5.

Figure 7:
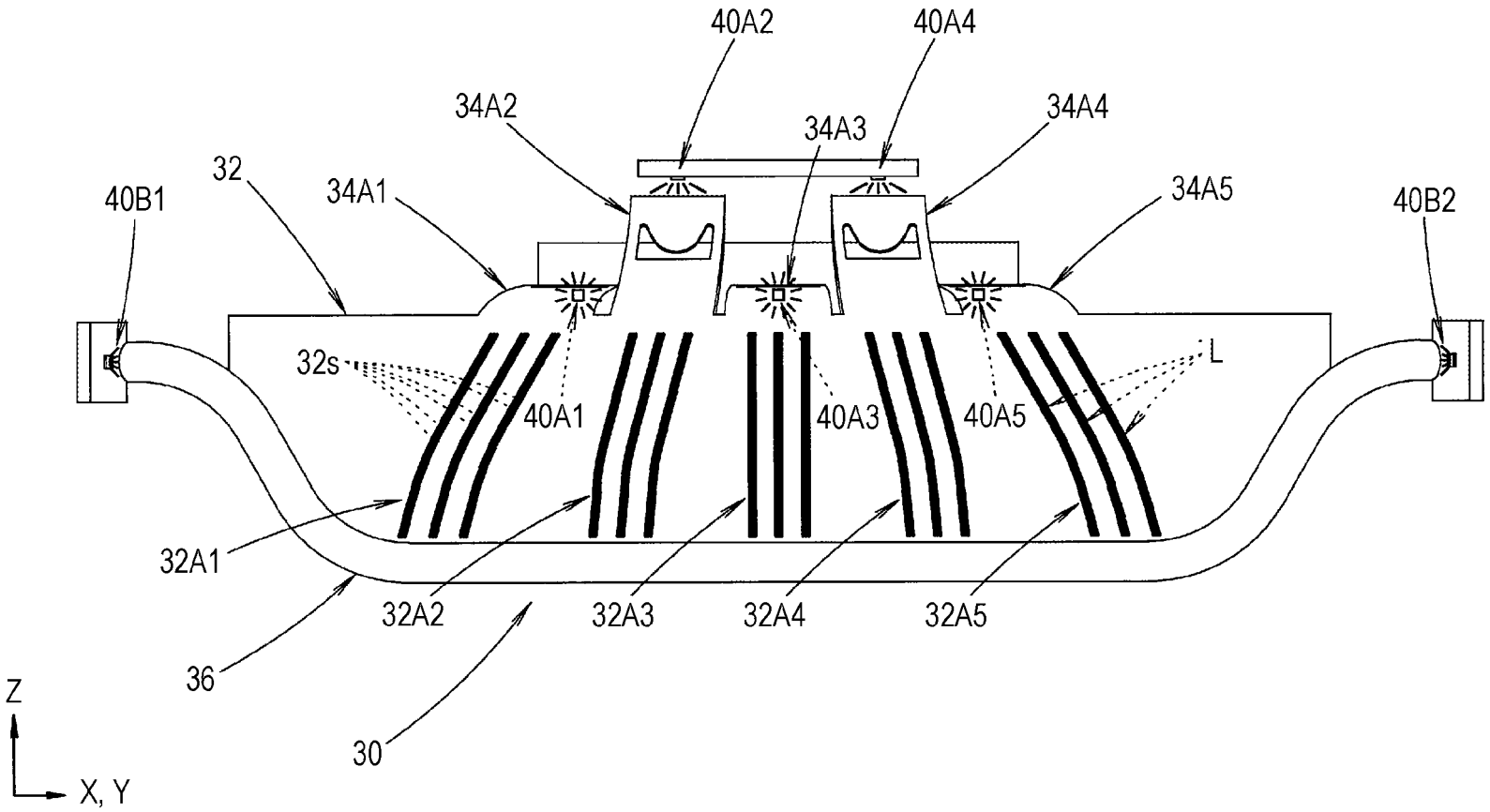
FIG. 7 is a view similar to FIG. 3 (No. 1), illustrating the light fixture unit in a lighting state.

FIG. 7 is a front view of the light fixture unit, illustrating the light fixture unit 20 in a state of being turned on in the tail lamp lighting mode.

As illustrated in the figure, when the light fixture unit 20 in a state in which the five light sources 40A1 to 40A5 and the two second light sources 40B1 and 40B2 are all turned on is observed from the front direction of the light fixture unit, in the light transmitting member 30, the light from the light sources 40A1 to 40A5 incident on the plate-shaped light guide 32 via the light incident members 34A1 to 34A5 is totally reflected by the reflective elements 32*s* formed in the light emitting regions 32A1 to 32A5, so that the light emitting regions 32A1 to 32A5 appear to shine in a strip shape and substantially uniformly along the three lines L.

At that time, in the light transmitting member 30, the light from the second light sources 40B1 and 40B2 incident on the plate-shaped light guide 32 via the rod-shaped light guide 36 is also totally reflected by the reflective elements 32*s* formed in the light emitting regions 32A1 to 32A5, so that the light emitting regions 32A1 to 32A5 appear to shine brighter and more uniformly over an entire length of the lines L.

Figure 8:
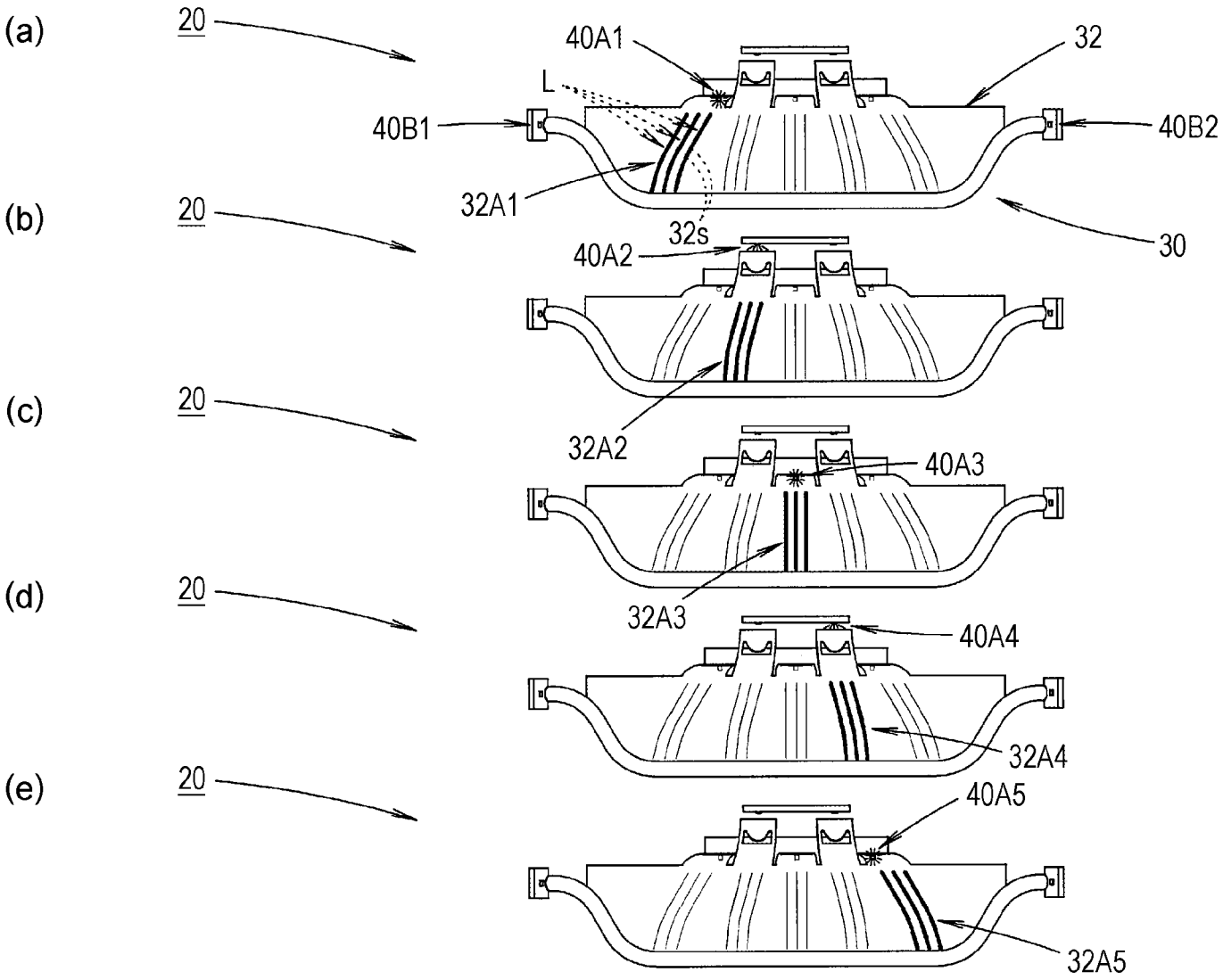
FIG. 8 is a view similar to FIG. 3 (No. 2), illustrating the light fixture unit in the lighting state.

FIG. 8 is a front view of the light fixture unit, illustrating the light fixture unit 20 in a state of being turned on in the welcome lamp lighting mode.

As described above, in the welcome lamp lighting mode, the five light sources 40A1 to 40A5 are individually turned on in the order of the light sources 40A1, 40A2, 40A3, 40A4, and 40A5.

That is, first, as illustrated in FIG. 8(*a*), the light emitting region 32A1 located at the left end appears to shine alone by turning on the light source 40A1, then as illustrated in FIG. 8(*b*), the second light emitting region 32A2 from the left appears to shine alone by turning on the light source 40A2, then as illustrated in FIG. 8(*c*), the light emitting region 32A3 located in the center appears to shine alone by turning on the light source 40A3, then as illustrated in FIG. 8(*d*), the second light emitting region 32A4 from the right appears to shine alone by turning on the light source 40A4, and finally, as illustrated in FIG. 8(*e*), the light emitting region 32A5 located at the right end appears to shine alone by turning on the light source 40A5.

At that time, the light emitting regions 32A1 to 32A5 appear to shine in a strip shape and substantially uniformly along the three lines L.

Such sequential lighting of the five light sources 40A1 to 40A5 is repeated once or a plurality of times.

Next, operational effects of the present embodiment will be described.

The vehicle light fixture 10 according to the present embodiment is configured such that the light fixture unit 20 totally reflects the light from five light sources 40A1, 40A2, 40A3, 40A4 and 40A5 incident on the plate-shaped light guide 32 by the reflective elements 32*s* formed on the first plate surface 32*a*, and then emits the light forward of the light fixture unit from the second plate surface 32*b*, but the five light emitting regions 32A1, 32A2, 32A3, 32A4 and 32A5 are arranged at intervals in the horizontal direction (required direction) in the plate-shaped light guide 32, the reflective elements 32*s* are arranged in a state of being continuously side by side along the line L extending in the direction intersecting the horizontal direction in each of the light emitting regions 32A1 to 32A5, each reflective element 32*s* has a substantially concave spherical surface shape, and the light sources 40A1 to 40A5 are configured to be able to be individually turned on in a state of being respectively arranged in the light emitting regions 32A1 to 32A5, so that the following operational effects can be obtained.

That is, in the plate-shaped light guide 32, in the light emitting regions 32A1 to 32A5 on which the light from the light sources 40A1 to 40A5 in the lighting state out of the five light emitting regions 32A1 to 32A5 is incident, the light from the light sources 40A1 to 40A5 is totally reflected by the reflective elements 32*s* and emitted forward of the light fixture unit from the second plate surface 32*b*, so that the plate-shaped light guide 32 can be made to appear to shine linearly along the line L.

At that time, since each reflective element 32*s* formed on the first plate surface 32*a* of the plate-shaped light guide 32 has the concave spherical surface shape, light reflection by total reflection in the reflective elements 32*s* will be performed substantially evenly in all directions. Therefore, even if the line-of-sight direction when observing the plate-shaped light guide 32 is significantly changed, it is possible to maintain a state in which the plate-shaped light guide 32 appears to shine linearly along the line L, so that optical fibers can be made to appear to shine in each of the light emitting regions 32A1 to 32A5.

Moreover, since the light sources 40A1 to 40A5 respectively arranged in the light emitting regions 32A1 to 32A5 are configured to be able to be individually turned on, it is also possible to selectively make a part of the five light emitting regions 32A1 to 32A5 appear to shine.

Then, by making a part or all of the five light emitting regions 32A1 to 32A5 appear to shine like the optical fibers in this way, the design characteristics of the vehicle light fixture 10 can be improved.

As described above, according to the present embodiment, in the vehicle light fixture 10 including the plate-shaped light guide 32, it is possible to improve the design characteristics when the light fixture is turned on.

Moreover, in the present embodiment, since the three lines L are arranged at intervals in the horizontal direction in each of the light emitting regions 32A1 to 32A5, in the light emitting regions 32A1 to 32A5 on which the light from the light sources 40A1 to 40A5 in the lighting state is incident, it is possible to make the three optical fibers appear to shine in a state of being arranged discretely, thereby further improving the effects of the design characteristics.

Further, in the present embodiment, since each of the light sources 40A1 to 40A5 includes the light emitting element, and each of the light incident members 34A1, 34A2, 34A3, 34A4 and 34A5 that allows the light from each of the light sources 40A1 to 40A5 to be incident on the plate-shaped light guide 32 so that the light is guided to each of the light emitting regions 32A1 to 32A5 is disposed between each of the light sources 40A1 to 40A5 and the upper end surface 32*c* (one end surface in a direction intersecting the required direction) of the plate-shaped light guide 32, even if each of the light sources 40A1 to 40A5 includes the light emitting element, it is possible to easily emit light only in the light emitting regions 32A1 to 32A5 corresponding to the light sources 40A1 to 40A5 by individually turning on the light sources.

At that time, since the light incident members 34A1 to 34A5 are formed to extend in different directions from each other from the upper end surface 32*c* of the plate-shaped light guide 32 between the light incident members adjacent to each other, even if the five light emitting regions 32A1 to 32A5 are close to each other, the five light incident members 34A1 to 34A5 and the five light sources 40A1 to 40A5 can be arranged without difficulty.

Further, in the present embodiment, the light fixture unit 20 is configured to include: the rod-shaped light guide 36 disposed to extend along the lower end surface 32*d* (the other end surface in the direction intersecting the required direction) of the plate-shaped light guide 32; and a pair of second light sources 40B1 and 40B2 arranged such that the light is incident on the rod-shaped light guide 36, and the rod-shaped light guide 36 is configured such that the light from the second light sources 40B1 and 40B2 incident on the rod-shaped light guide 36 is incident on the plate-shaped light guide 32 from the lower end surface 32*d*, and thus it is possible to increase brightness of the five light emitting regions 32A1 to 32A5 by additionally turning on the second light sources 40B1 and 40B2 when the five light emitting regions 32A1 to 32A5 emit light by simultaneously turning on the five light sources 40A1 to 40A5.

In the above embodiment, the five light incident members 34A1 to 34A5 and the rod-shaped light guide body 36 have been described as being integrally formed with the plate-shaped light guide body 32, but they can also be configured as members different from the plate-shaped light guide 32.

In the above embodiment, it has been described that the reflective elements 32*s* have the concave spherical surface shape, but it is also possible to employ a configuration having a substantially concave curved surface shape including a concave ellipsoidal surface close to the concave spherical surface, a substantially concave spherical surface such as a concave polyhedron, and the like, and it is also possible to employ a configuration having the convex curved surface shape.

In the above embodiment, in the welcome lamp lighting mode, it has been described that the five light sources 40A1 to 40A5 are individually turned on in the order of the light sources 40A1, 40A2, 40A3, 40A4, and 40A5, but it is also possible to employ a configuration in which two light sources are turned on at a time, or a configuration in which the number of light sources turned on is gradually increased or decreased.

In the above embodiment, a case where the vehicle light fixture 10 is the tail lamp also having a function as the welcome lamp has been described, but by employing the same configuration as that of the above embodiment, the same operational effects as that of the above embodiment can be obtained regardless of location and function of lamps provided in the vehicle, such as a stop lamp, a turn signal lamp, a clearance lamp, and a daytime running lamp, and the like in addition to the tail lamp.

Next, a modification of the above embodiment will be described.

Figure 9:
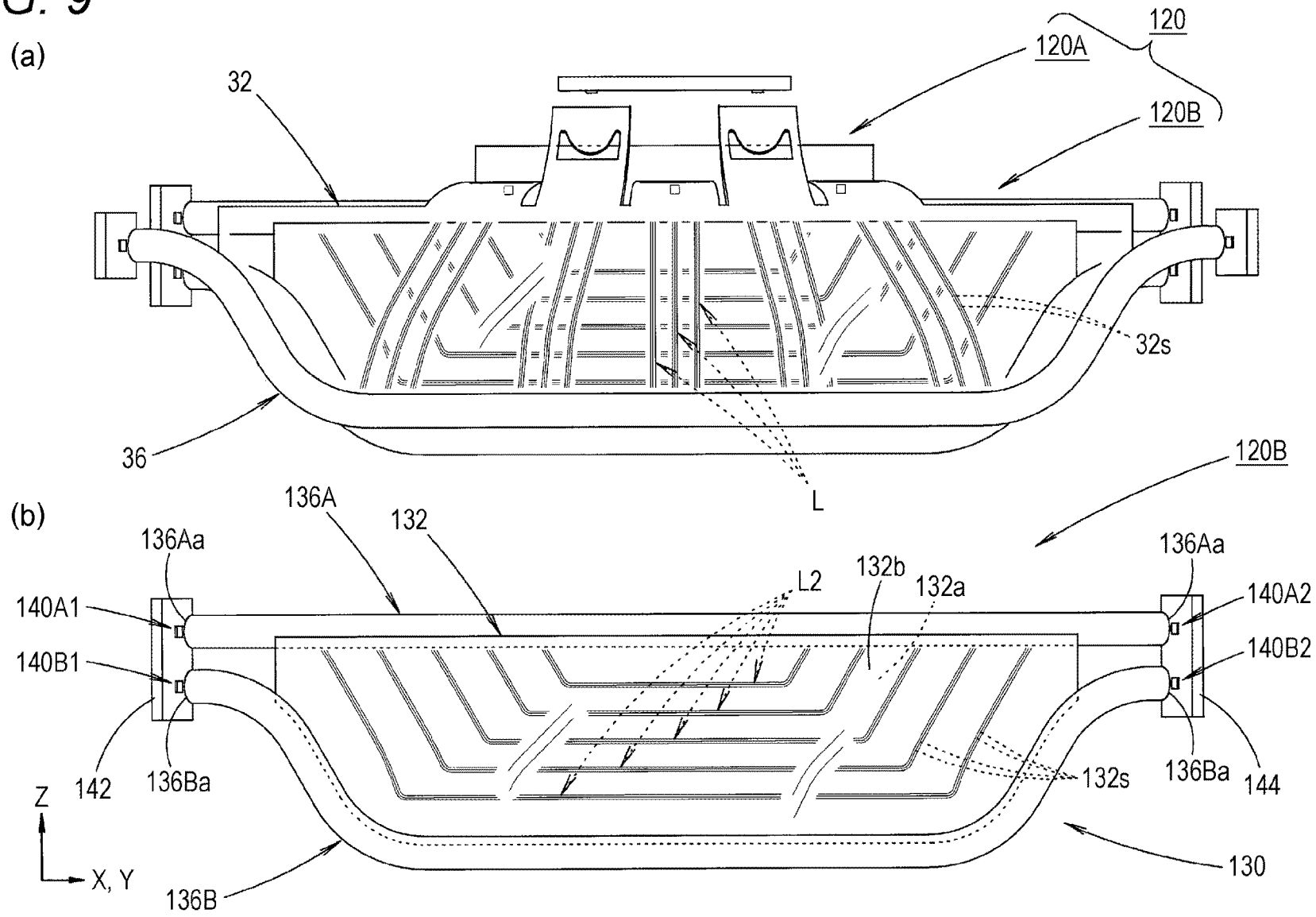
FIG. 9(*a*) is a view similar to FIG. 3, illustrating the light fixture unit according to a modification of the embodiment, and FIG. 9(*b*) is a view similar to FIG. 3, illustrating as a single item a second light fixture unit constituting a part of the light fixture unit according to the modification.

FIG. 9(*a*) is a view similar to FIG. 3, illustrating a light fixture unit 120 of the vehicle light fixture according to the present modification.

As illustrated in FIG. 9(*a*), the light fixture unit 120 is configured such that a second light fixture unit 120B is additionally disposed on a rear side of a first light fixture unit 120A (also on the rear side of the light fixture) having the same configuration as the light fixture unit 20 of the above embodiment.

FIG. 9(*b*) is a view similar to FIG. 9(*a*), illustrating the second light fixture unit 120B as a single item.

As illustrated in FIG. 9(*b*), the second light fixture unit 120B is configured to include a light transmitting member 130 and four third light sources 140A1, 140A2, 140B1 and 140B2.

The light transmitting member 130 is the colorless transparent resin member, and is configured such that a plate-shaped light guide 132 and two rod-shaped light guides 136A and 136B are integrally formed.

Similar to the plate-shaped light guide 32 of the first light fixture unit 120A, the plate-shaped light guide 132 has a substantially inverted trapezoidal outer shape in which both left and right ends are inclined obliquely upward in the front view of the light fixture unit, and has a vertical cross-sectional shape substantially similar to that of the plate-shaped light guide 32 of the first light fixture unit 120A.

Further, also in the plate-shaped light guide 132, a plurality of reflective elements 132*s* is formed on a first plate surface 132*a* on the rear surface side of the plate-shaped light guide 132.

However, in the plate-shaped light guide 132, the reflective elements 132*s* are arranged in a state of being continuously side by side along five lines L2 extending in a substantially U shape in the front view of the light fixture unit. At that time, the five lines L2 are arranged at intervals substantially concentrically so as to be substantially similar to each other.

The arrangement of the reflective elements 132*s* on each line L2 is the same as the arrangement of the reflective elements 32*s* on each line L of the first light fixture unit 120A, and a shape of each reflective element 132*s* is the same as the shape of each reflective element 32*s* of the first light fixture unit 120A.

The two rod-shaped light guides 136A and 136B are both formed in a columnar shape having substantially the same diameter as the rod-shaped light guide 36 of the first light fixture unit 120A.

The rod-shaped light guide 136A extends in the horizontal direction along the upper end edge of the plate-shaped light guide 132, both ends thereof project from the side end surface of the plate-shaped light guide 132, and tip surfaces 136Aa thereof are both made of a vertical surface.

The rod-shaped light guide 136B extends in the horizontal direction along the lower end edge of the plate-shaped light guide 132, and portions near both ends of the rod-shaped light guide 136B extend obliquely upward corresponding to the lower end edge of the plate-shaped light guide 132 inclined obliquely upward, and further, both ends of the rod-shaped light guide 136B extend in the horizontal direction so as to be separated from a side end surface of the plate-shaped light guide 132, and tip surfaces 136Ba of the rod-shaped light guide 136B are both formed of a vertical plane.

The tip surfaces 136Aa and 136Ba at both ends of the two rod-shaped light guides 136A and 136B are formed of vertical planes located on the same plane.

The two third light sources 140A1 and 140A2 are arranged in the vicinity of the tip surfaces 136Aa at both ends of the rod-shaped light guide 136A with their light emitting surfaces facing the tip surfaces 136Aa. Then, the third light sources 140A1 and 140A2 are respectively configured to allow the light emitted from the third light sources 140A1 and 140A2 to be incident on the rod-shaped light guide 136A from their tip surfaces 136Aa, and allow the light to be incident on the plate-shaped light guide 132 via the rod-shaped light guide 136A.

The two third light sources 140B1 and 140B2 are arranged in the vicinity of the tip surfaces 136Ba at both ends of the rod-shaped light guide 136B with their light emitting surfaces facing the tip surfaces 136Ba. Then, the third light sources 140B1 and 140B2 are respectively configured to allow the light emitted from the third light sources 140B1 and 140B2 to be incident on the rod-shaped light guide 136B from their tip surfaces 136Ba, and allow the light to be incident on the plate-shaped light guide 132 via the rod-shaped light guide 136B.

The two third light sources 140A1 and 140B1 are mounted on a common substrate 142, and the two light sources 140A2 and 140B2 are mounted on a common substrate 144.

Then, the plate-shaped light guide 132 is configured to totally reflect the light emitted from the third light sources 140A1 to 140B2 incident on the plate-shaped light guide 132 by the reflective elements 132*s*, and then emit the light forward of the light fixture unit from a second plate surface 132*b* of the plate-shaped light guide 132.

The second light fixture unit 120B is configured such that all four third light sources 140A1 to 140B2 are simultaneously turned on in the tail lamp lighting mode.

Figure 10:
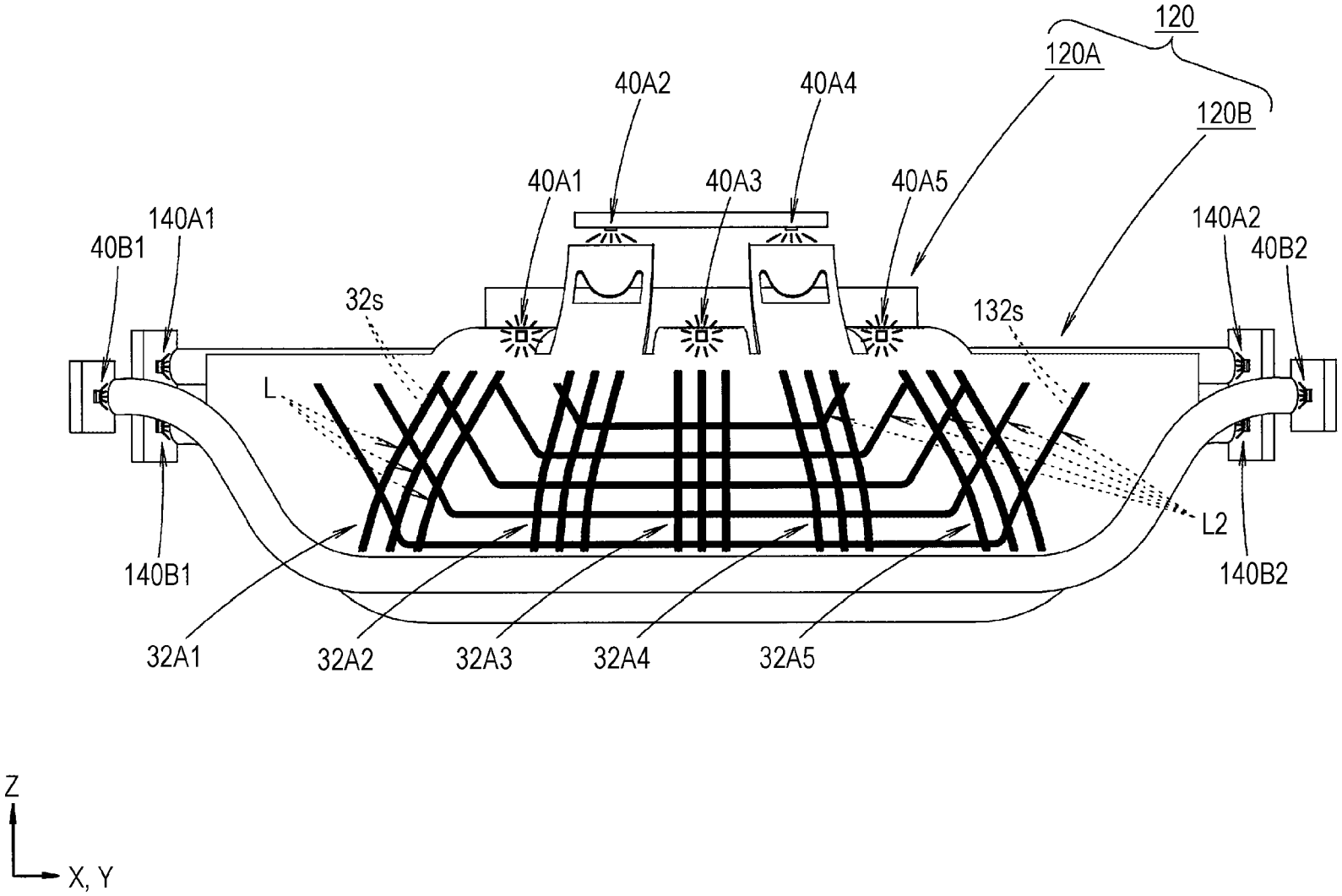
FIG. 10 is a view similar to FIG. 9(*a*), illustrating the light fixture unit according to the modification in the lighting state.

FIG. 10 is a front view of the light fixture unit, illustrating the light fixture unit 120 in a state of being turned on in the tail lamp lighting mode.

As illustrated in the figure, in the first light fixture unit 120A, similarly to the light fixture unit 20 of the above embodiment, the reflective elements 32*s* appear to shine in a strip shape and substantially uniformly along the three lines L in the five light emitting regions 32A1 to 32A5 by simultaneously turning on the five light sources 40A1 to 40A5 and the two second light sources 40B1 and 40B2.

Further, in the second light fixture unit 120B, the reflective elements 132*s* appear to shine in a strip shape and substantially uniformly along the five lines L2 by simultaneously turning on the four third light sources 140A1 to 140B2. At that time, since the five lines L2 are arranged substantially concentrically so as to extend in a substantially U shape in the front view of the light fixture unit, the five lines L2 appears to shine in a state of intersecting the three lines L in the light emitting regions 32A1 to 32A5. At that time, the five lines L2 appear to shine at positions away from the rear side of the light fixture unit with respect to the three lines L in the light emitting regions 32A1 to 32A5.

Therefore, by employing the configuration of the present modification, it is possible to produce a bright and deep light emitting state as the light fixture unit 120, thereby improving the design characteristics when the light fixture is turned on.

Further, as illustrated in FIG. 9, even when the light fixture unit 120 is in a non-lighting state, the five lines L2 can be seen extending in a direction intersecting the three lines L in each of the light emitting regions 32A1 to 32A5 at a position away from the rear side of the light fixture unit, so that the light fixture unit 120 can have a sense of depth, thereby improving the design characteristics when the light fixture is not turned on.

It should be noted that numerical values shown as specifications in the above embodiment and modification are merely examples, and it goes without saying that they may be set to different values as appropriate.

Further, the present invention is not limited to the configurations described in the above embodiment and modification, and other configurations to which various modifications are added can be employed.

This international application claims priority based on Japanese Patent Application No. 2019-075512 filed on Apr. 11, 2019, and the entire contents of Japanese Patent Application No. 2019-075512, which is the Japanese patent application, is incorporated by reference in this international application.

The above description of a specific embodiment of the present invention is presented for purposes of illustration. They are not intended to be exhaustive or to limit the present invention to the embodiments described above as they are. It will be obvious to those skilled in the art that numerous modifications and changes can be made in the light of the above description.

LIST OF REFERENCE SIGNS

10: Vehicle light fixture, 12: Lamp body, 14: Light transmitting cover, 16: Extension member, 20, 120: Light fixture unit, 30, 130: Light transmitting member, 32, 132: Plate-shaped light guide, 32*a*, 132*a*: First plate surface, 32A1, 32A2, 32A3, 32A4, 32A5: Light emitting region, 32*b*, 132*b*: Second plate surface, 32*c*: Upper end surface (One end surface), 32*d*: Lower end surface (Other end surface), 32*s*, 132*s*: Reflective element, 34*a*, 36*a*, 136Aa, 136Ba: Tip surface, 34A1, 34A2, 34A3, 34A4, 34A5: Light incident member, 34*b*: Light control opening, 34*c*, 34*d*: Inner wall surface, 36, 136A, 136B: Rod-shaped light guide, 40A1, 40A2, 40A3, 40A4, 40A5: Light source, 40B1, 40B2: Second light source, 42A1, 42A2, 42B1, 42B2, 142, 144: Substrate, 120A: First light fixture unit, 120B: Second light fixture unit, 140A1, 140A2, 140B1, 140B2: Third light source, D: Outer diameter, L, L2: Line, W: Width.

The invention claimed is:

1. A vehicle light fixture comprising:

a plurality of light sources arranged in a first direction and a plate-shaped light guide, wherein the plate-shaped light guide is configured such that light from the light sources incident on the plate-shaped light guide are totally reflected by a plurality of reflective elements formed on a first plate surface of the plate-shaped light guide, and then emitted forward of the light fixture from a second plate surface of the plate-shaped light guide, a plurality of light emitting regions is arranged at intervals in the first direction in the plate-shaped light guide, the reflective elements are arranged in a state of being continuously side by side along a line extending in a direction intersecting the first direction in each of the light emitting regions, each of the reflective elements has a substantially spherical surface shape, the light sources are disposed in each of the light emitting regions, and the light sources are configured to be able to be individually turned on, each of the light sources includes a light emitting element, a plurality of light incident members is disposed between each of the light sources and one end surface of the plate-shaped light guide in the direction intersecting the first direction, the light incident members are formed to extend from the one end surface, each of the light sources is respectively arranged in the vicinity of a tip surface of each of the light incident members with a light emitting surface of each of the light sources facing the tip surface, and each of the light incident members allows light from each of the light sources incident into each of the light incident members from the tip surface to be incident on the plate-shaped light guide so that the light is guided to each of the light emitting regions.

2. The vehicle light fixture according to claim 1, wherein a plurality of the lines is arranged at intervals in the first direction in each of the light emitting regions.

3. The vehicle light fixture according to claim 1, wherein one of the light incident members and another one of the light incident members, which is adjacent to the one of the light incident members, are formed to extend in different directions from each other from the one end surface.

4. The vehicle light fixture according to claim 1, comprising:

a rod-shaped light guide disposed to extend along the other end surface of the plate-shaped light guide in the direction intersecting the first direction; and a second light source disposed such that light is incident on the rod-shaped light guide, wherein the rod-shaped light guide is configured such that the light from the second light source incident on the rod-shaped light guide is incident on the plate-shaped light guide from the other end surface.

5. A vehicle light fixture comprising:

a plurality of light sources arranged in a first direction, a plate-shaped light guide, wherein the plate-shaped light guide is configured such that light from the light sources incident on the plate-shaped light guide are totally reflected by a plurality of reflective elements formed on a first plate surface of the plate-shaped light guide, and then emitted forward of the light fixture from a second plate surface of the plate-shaped light guide, a plurality of light emitting regions is arranged at intervals in the first direction in the plate-shaped light guide, the reflective elements are arranged in a state of being continuously side by side along a line extending in a direction intersecting the first direction in each of the light emitting regions, each of the reflective elements has a substantially spherical surface shape, the light sources are disposed in each of the light emitting regions, and the light sources are configured to be able to be individually turned on, a second plate-shaped light guide disposed behind the light fixture from the plate-shaped light guide, and a third light source disposed such that light is incident on the second plate-shaped light guide, wherein the second plate-shaped light guide is configured such that the light from the third light source incident on the second plate-shaped light guide is totally reflected by a plurality of reflective elements formed on a first plate surface of the second plate-shaped light guide, and then emitted forward of the light fixture from a second plate surface of the second plate-shaped light guide.

* * * * *